United States Patent [19]

Huston et al.

[11] 3,943,395

[45] Mar. 9, 1976

[54] TUBULAR INCANDESCENT LAMP HAVING SPACED SEGMENTS

[75] Inventors: Leroy Huston, Candia, N.H.; George D. Gounaris, Haverhill, Mass.

[73] Assignee: GTE Sylvania Incorporated, Danvers, Mass.

[22] Filed: Dec. 6, 1974

[21] Appl. No.: 530,118

[52] U.S. Cl. ..... 313/273; 313/315; 313/344

[51] Int. Cl.[2] ..... H01K 1/24

[58] Field of Search ..... 313/273, 315, 344, 222, 313/274

[56] References Cited

UNITED STATES PATENTS

| | | | |
|---|---|---|---|
| 3,211,943 | 10/1965 | Cardwell, Jr. | 313/315 |
| 3,295,007 | 12/1966 | Young | 313/273 |
| 3,376,460 | 4/1968 | Jameson | 313/344 |
| 3,416,024 | 12/1968 | Young | 313/273 |

*Primary Examiner*—Alfred E. Smith
*Assistant Examiner*—Wm. H. Punter
*Attorney, Agent, or Firm*—James Theodosopoulos

[57] ABSTRACT

In a tubular, double ended electric incandescent lamp in which the filament comprises coiled segments spaced from each other, the filament coiled segments are electrically connected by means of skip space wire sections coiled at each end thereof, which are threaded onto the filament segments.

2 Claims, 2 Drawing Figures

TUBULAR INCANDESCENT LAMP HAVING SPACED SEGMENTS

THE INVENTION

This invention relates generally to tubular, elongated, double ended electric incandescent lamps having an axially extending coiled filament. Such lamps are used, for example, in photocopy equipment and for infrared heating purposes.

In some cases, where the designed lamp wattage is low in relation to the length of the lamp, it is impractical to make a coiled filament continuous for the entire length of the lamp; in such cases, the filament can consist of coiled segments spaced apart from each other and is called a segmented filament.

In a tubular lamp having a segmented filament, the axial coil segments must be connected by some means to make a complete filament. If the filament were made of one continuous wire, coiled in segments with relatively straight wire sections between the coiled segments, the filament might not remain axially centered with respect to the lamp envelope for the following reason. When the lamp is switched on and off, the coiled segments of the filament may shift with respect to the axis of the lamp. This action is caused primarily by the straight wire sections of the filament. When the lamp is switched on, the entire filament is heated by the current passing through the wire. The coiled sections tend to expand in diameter but the straight sections expand linearly and distort the coil from a straight axial position. Repetition of this action by switching the lamp on and off fatigues the coil and causes premature failure of the lamps.

The prior art method of solving this problem involved the use of threaded rods between coil segments. The threaded rods were of relatively large diameter and did not heat up greatly; consequently the expansion of these rods was negligible and the segmented filament was not distorted. But threaded rods are expensive and require additional filament supports in order to support the added weight of the rods.

The purpose of this invention is to provide a simpler, improved, less expensive means of connecting such coiled filament segments.

In our invention, the coiled filament segments are connected by spacer wire sections coiled at each end. Each spacer wire section is made of a single length of wire, the end portions thereof being coiled and the center portion thereof being relatively uncoiled. Such spacer wire sections can be readily formed on so-called 4G coiling machines, which can automatically and continuously wind wire from a spool into coils having predetermined dimensions and spaced apart by a skip-space, so-called, in which the wire is relatively uncoiled.

The coiled ends of the spacer wire sections are designed to thread onto the coiled filament segments in order to provide a secure mechanical and electrical connection therebetween. In addition, the spacer wire section is made of wire having a larger diameter than the filament wire so that, during operation, the spacer wire section does not heat up sufficiently to cause appreciable expansion thereof.

Figure 1:
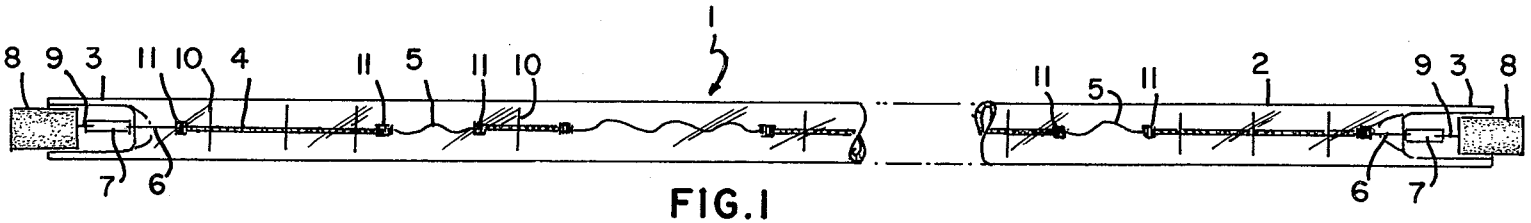
FIG. 1 is a broken elevational view of an incandescent lamp in accordance with this invention.
Figure 2:
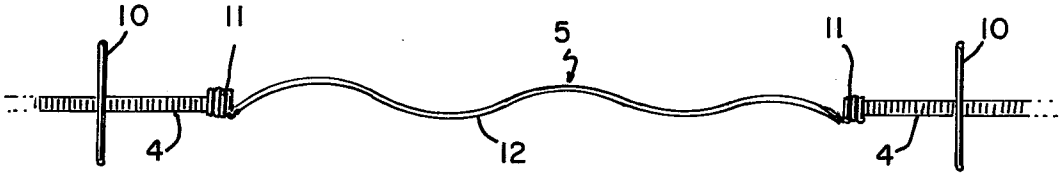
FIG. 2 is a detail view on a larger scale of a spacer wire section of the invention.

An example of an incandescent lamp 1, in accordance with this invention, comprises an elongated tubular glass envelope 2 having press seals 3 at each end thereof. Axially disposed within evnelope 2 is a segmented filament comprising filament coiled segments 4 separated by spacer wire sections 5. The ends of the filament are connected, by wires 6, to thin molybdenum ribbons 7, embedded in press seals 3, which in turn are connected to external contacts 8 by means of wires 9. The filament is maintained axially within envelope 2 by means of filament supports 10.

Spacer wire section 5 is made of larger diameter wire than the wire of filament coiled segment 4 in order that spacer wire section 5 not be heated up as much as filament coiled segment 4 during lamp operation. Each end 11 of spacer wire section 5 is coiled to a diameter and pitch that permits it to be threaded onto the end of filament coiled segment 4 and to form a secure mechanical and electrical connection therebetween. The intermediate portion 12 of spacer wire section 5, between ends 11, is, although not straight, relatively uncoiled or, in other words, coiled at a considerably lower pitch than end 11, such as would be obtained from a skip-space coiling machine, for example, a 4G coiling machine.

In a 1000 watt, 280 volt, T2½ lamp in accordance with this invention, envelope 2 was made of quartz and had an overall length of 16 inches. The filament consisted of eight filament coiled segments 4, made of 5.8 mil diameter tungsten wire coiled on a 24 mil mandrel at 108 turns per inch, and seven spacer wire sections 5, made of 9 mil diameter tungsten wire coiled on a 34 mil mandrel. The segments 4 at each end of the filament had a body length of 33 mm and the other six segments 4 had a body length of 16 mm.

The spacer wire sections 5 at each end of the filament had an overall length of 17 mm, which consisted of a coil 11 having a length of about 1½ mm, at 106 TPI, at each end thereof and a skip-space portion 12 that was about 14 mm long; said portion 12 had about two coiled turns stretched throughout its length. In the other five spacer wire sections 5, coils 11 were the same but each skip-space portion 12 was 31 mm long and had about four coiled turns stretched throughout its length.

The filament was axially maintained within envelope 2 by means of a filament support 10 on each intermediate coiled segment 4 and three supports 10 on each end coiled segment 4.

In this example, the ratio of the wire diameter of spacer wire section 5 to the wire diameter of filament coiled segment 4 was 1.55 to 1. In order that spacer wire section 5 have sufficient mass to prevent excessive heating thereof, which could cause appreciable expansion, but without requiring additional support therefor, such as by additional filament supports 10, such ratio should be between about 1.3 and 1.8.

In some photocopy applications, a lamp having a segmented filament is moved back and forth to scan the area to be reproduced. In prior art lamps, in which the segmented coils are connected with threaded rods, the filament may distort during this back and forth motion. The distortion is caused by the added weight of the solid threaded rod. Additional filament supports could limit this distortion but, because of the manufacturing tolerances of the supports and the glass envelopes, could not eliminate it. In lamps made in accordance with this invention, filament distortion in scanning applications was negligible.

We claim:

1. In an elongated, tubular, double-ended incandescent lamp of the type where the filament is axially located and comprises separated filament coiled segments, the improvement which comprises spacer wire sections between said coiled segments, each spacer wire section consisting of a single length of wire and further consisting of a coil at each end thereof with an intermediate skip-space therebetween, each of said coils being electrically and mechanically fastened to the adjacent filament coiled segment by being threaded onto the end of said adjacent filament coiled segment, the diameter of the wire of said spacer wire section being larger than the diameter of the wire of said filament coiled segment.

2. The lamp of claim 1 wherein the ratio of said respective diameters is between about 1.3 and 1.8.

* * * * *